United States Patent [19]

Pringle et al.

[11] Patent Number: 4,750,097

[45] Date of Patent: Jun. 7, 1988

[54] LAMP REFLECTOR ASSEMBLY

[75] Inventors: David A. Pringle, Pacific Palisades; Helen Gourley, San Francisco, both of Calif.

[73] Assignee: Optech Inc., Burbank, Calif.

[21] Appl. No.: 934,833

[22] Filed: Nov. 25, 1986

Related U.S. Application Data

[63] Continuation-in-part of Ser. No. 791,214, Oct. 25, 1985, Pat. No. 4,686,612.

[51] Int. Cl.[4] ..... F21V 7/04

[52] U.S. Cl. ..... 362/297; 362/346; 362/350

[58] Field of Search ..... 362/217, 297, 299, 301, 362/346, 349, 350, 373, 294, 345

[56] References Cited

U.S. PATENT DOCUMENTS 1,711,478 4/1929 Halvorson, Jr. ..... 362/301

4,539,628 9/1985 Bartenbach ..... 362/217

*Primary Examiner*—Larry I. Schwartz

*Attorney, Agent, or Firm*—Ladas & Parry

[57] ABSTRACT

A reflecting mirror for reflecting a beam of light emitted from a light source along an optical axis, the mirror comprising at least two spherical sections. Each section is arranged to produce an image of the light source adjacent to but not coincident with the light source.

11 Claims, 4 Drawing Sheets

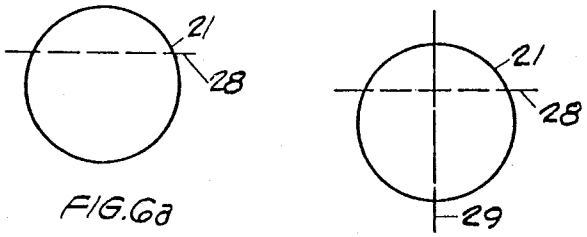
FIG. 6a
FIG. 6d
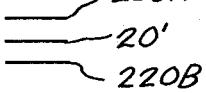
FIG. 7A
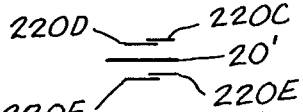
FIG. 7B
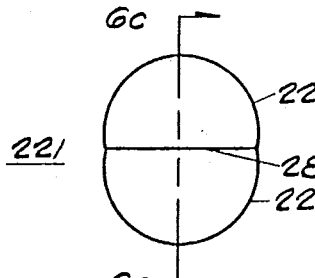
FIG. 6b
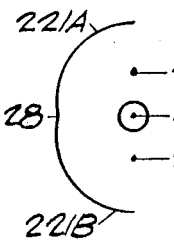
FIG. 6c
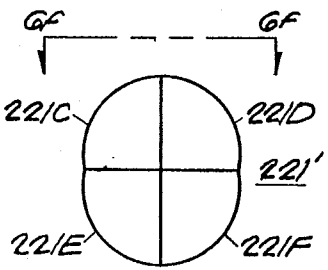
FIG. 6e
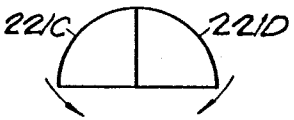
FIG. 6f

LAMP REFLECTOR ASSEMBLY

CROSS REFERENCE TO RELATED APPLICATIONS

This application is a continuation-in-part of U.S. patent application No. 791,214 filed Oct. 25, 1985, now U.S. Pat. No. 4,686,612.

TECHNICAL FIELD

This invention relates to lamp reflectors and more particularly to reflectors of the type which may be conveniently used with high energy lamps. Such lamps and the reflector of the instant invention may be conveniently used to light a scene during the making of a movie, for theatrical and TV productions, and the like.

BACKGROUND OF THE INVENTION

In the prior art, electrically powered lamps, for example, arc lamps, are commonly used to illuminate a movie scene, a theatrical set, a musical or television production, or the like. The lamp is typically mounted within an enclosure adjacent to a reflecting mirror and arranged so as to cast light through a Fresnel lens mounted on the enclosure. The reflecting mirror and lamp are movably mounted so as to permit the light cast by the lamp to either "flood" a scene or merely to cast a "spot" of light or something between these two extremes.

The lamp used in such applications is usually rated at several hundred or thousand watts and, in the prior art, only a portion of the light generated by the lamp is projected through the lens. A significant portion (up to two-thirds or even more) of the light is lost within the enclosure, causing the enclosure to heat significantly. This results not only in lost or wasted power, but also the excessive heating of the enclosure and its components. The lamp itself may be an arc lamp, quartz lamp, metal halide lamp or any other type of lamp.

BRIEF DESCRIPTION OF THE INVENTION

Briefly, and in general terms, the instant invention provides a lighting system comprising a housing with a lens or aperture mounted therein, a lamp or other bulb mounted within the enclosure and a reflecting mirror for projecting a portion of the light emitted by the lamp through the lens or aperture. The reflecting mirror has at least two spherical sections, each one of which is arranged to produce an image of the filament in the lamp immediately adjacent to the filament but not coincident with the filament thereby making the light source appear to be larger than the size of the filament.

BRIEF DESCRIPTION OF THE DRAWINGS

FIG. 1 is a front elevational view of a lamp assembly of the type employing the instant invention and which may be used to light a scene for the production of a movie, a theatrical play, or the like.

FIG. 6A is a front elevational view of a spherical reflector showing a part line for dividing same.

FIG. 6B is a front elevational view of a double section reflector.

FIG. 6C is a side sectional view of the reflector of FIG. 6B.

FIG. 6D is a front elevation view of a spherical reflector showing two part lines for dividing same.

FIG. 6E is a front elevation view of a quad section reflector.

FIG. 6F is a plan view of the reflector of FIG. 6E.

FIG. 7A is a front elevational view of a filament as well as the two images thereof produced by the spherical reflector of FIGS. 6B and 6C.

FIG. 7B is a front elevational view of the filament and the four images thereof produced by the quad section reflector described with reference to FIGS. 6D–6F.

FIG. 1 is a front elevational view of a lamp of the type which may employ the instant invention and which may be used to light a scene for movie making, be used for theatrical productions, television productions, or musical productions or the like. The lamp assembly conventionally has a lamp 20, which may be an arc lamp, quartz lamp, metal halide lamp or other type of lamp mounted within a housing 10. Preferably, a Fresnel lens 11 is mounted on an axis 12 adjacent to the housing 10 which permits it to rotate to fill an aperture 13 in housing 10. Preferably, the rotatably mounted Fresnel lens 11 provides access to the lamp or bulb 20 and interacts with a safety switch 14 which de-energizes the lamp when the lens is rotated to the position shown in FIG. 1, that is, to a position permitting access to the bulb 20. When the lens 11 is rotated to its position filling aperture 13 (as shown in FIG. 2), switch 14 is closed permitting bulb 20 to be energized.

Figure 2:
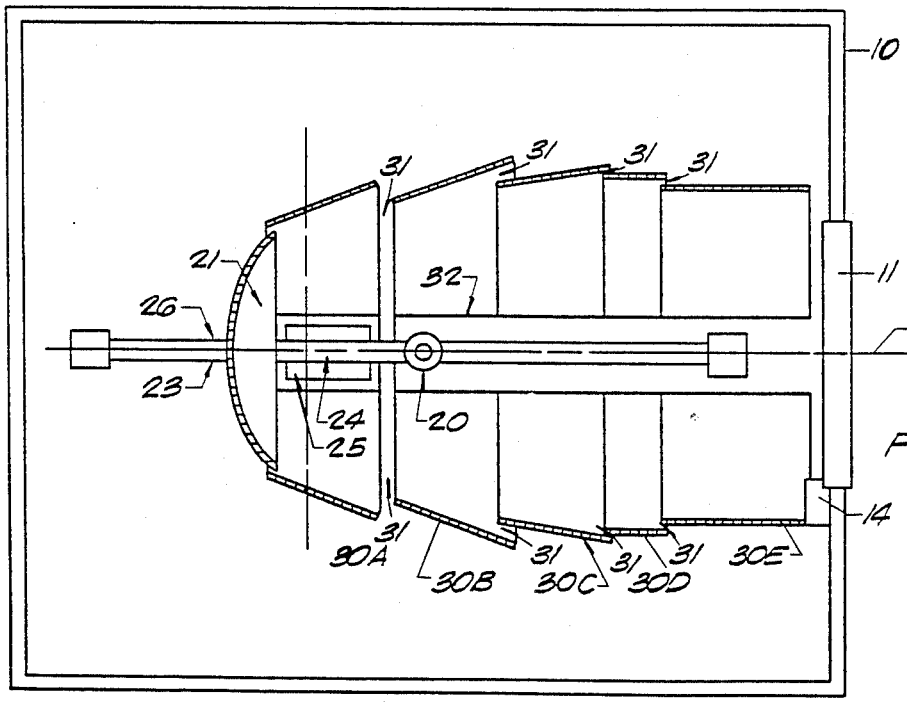
FIG. 2 is a diagrammatical, sectional view through the lamp assembly of FIG. 1, but drawn to a larger scale to more clearly depict the internal structure of the lamp.

As can be more clearly seen in FIG. 2, a movable reflector 21 is provided on the opposite side of lamp 20 from lens 11. Incidentally lens 11 is shown in its closed position in FIG. 2. The reflector is usually a spherical reflector and the lamp is disposed at, or slightly above or below, the center of the sphere defined by the spherical reflector 21. The diameter of the perimeter of reflector 21 is determined by the geometry in its forwardmost (the "flood") position. Its diameter should be such that the angle subtended at the lamp 20 by the Fresnel lens 11 equals the angle subtended at the lamp 20 in the backward direction by the reflector 21. This means that in the spot position part of this reflector 21 is not useful because it directs light to the interior wall of the enclosure 10 around lens 11.

Lamp 20 and reflector 21 are preferably mounted on a carriage arrangement 23, one side half of which can be seen in FIG. 2 and which comprises a support structure 24, a bearing block 25 and rail 26. Preferably, the spatial position of lamp 20 is fixed relative to reflector 21 by the support structure 24. Carriage 23 allows lamp 20 and reflector 21 assembly to be moved relative to lens 11, permitting the device to either cast a "flood" of light (reflector forward) or a "spot" of light (reflector back) or something therebetween. Conventionally, in the prior art, that portion of the light which did not either exit via lens 11 directly or after being reflected by reflector 21 was lost within enclosure 10, causing the enclosure and its components to rise in temperature. In accordance with the instant invention, however, a plurality of reflector segments 30A–30E which may be fixed within the enclosure by conventional means, are disposed generally radially outwardly of the reflector 21 and arranged at appropriate angles so as to reflect light rays from lamp 20 towards lens 11.

The individual segments 30A–30E may be disposed in a slightly overlapping fashion so as to not permit any appreciable amount of light to escape between the adjacent segments. The overlapping arrangement also provides air spaces permitting air currents 31 to better cool lamp 20. Five segments 30A–30E are shown in FIG. 2, but that number of segments depicted was selected for the ease of illustration and their positions relative to the reflector 21 and lamp 20 in FIG. 2 likewise for ease of illustration merely to convey the general idea. A preferred arrangement of reflectors 30A–30E will be described with reference to FIG. 5. More or fewer segments may be used as conditions dictate, but, generally speaking, as the number of segments increase, the air circulation improves, and the capability of the segments to direct the light rays reflected therefrom to desired locations on the lens 11 also improves.

Figure 1:
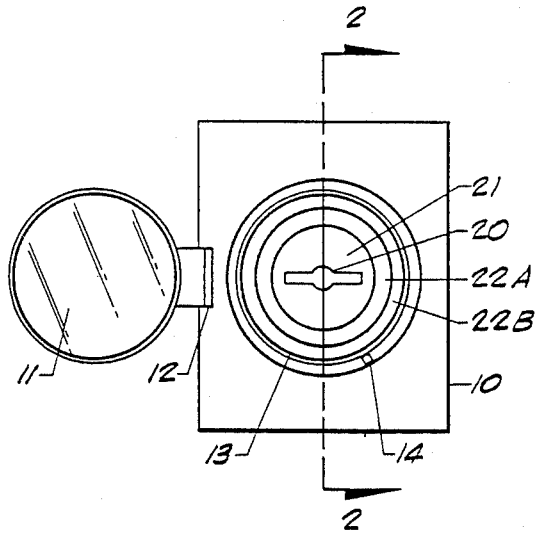

The segments are preferably defined by portions of a cone or cylinder and are preferably split into upper and lower halves to provide a clearance 32 in which support structure 24 may move when the carriage 23 is moved. While some loss of reflection efficiency is caused by the split, the loss is not particularly significant since lamp 20, when of the physical type depicted in FIGS. 1 and 2, does not direct much light towards the split.

The rear most reflector segment, segment 30A, may be arranged with an aperture at its distal end smaller than or equal to the perimeter diameter of mirror 21 provided that mirror 21 reaches it rearwardmost extent of movement on the carriage 23 before it contacts reflector segment 30A or alternatively provided that segment 30A is fixed to mirror 21.

Figure 3:
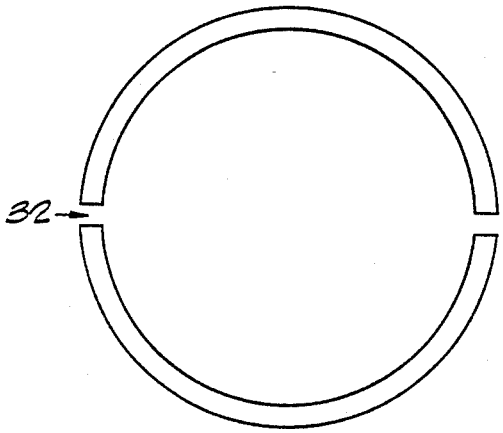
FIG. 3 is a front elevational view through one of the conical reflector segments shown in FIG. 2.

The optical axis of movable reflector 21, lamp 20 and lens 11 is identified by numeral 27. The individual reflector segments 30A–30D are shown disposed at an angle to the optical axis to help reflect light towards lens 11. As will be seen, they can be alternatively disposed to reflect light to reflector 21. Reflector segments 30A–30D define split segments of a cone. Reflector segment 30E, on the other hand, is shown with its reflecting surface parallel to the optical axis 27 and therefore is defined by a split segment of a cylinder. In any case, the interior surfaces of the segments 30A–30E preferably have a highly reflective surface for urging diverging light back along the optical axis 27. In cross section, any one of the segments 30A–30E depicted in FIG. 2 would define a split circle, as is shown in FIG. 3.

Figure 5:
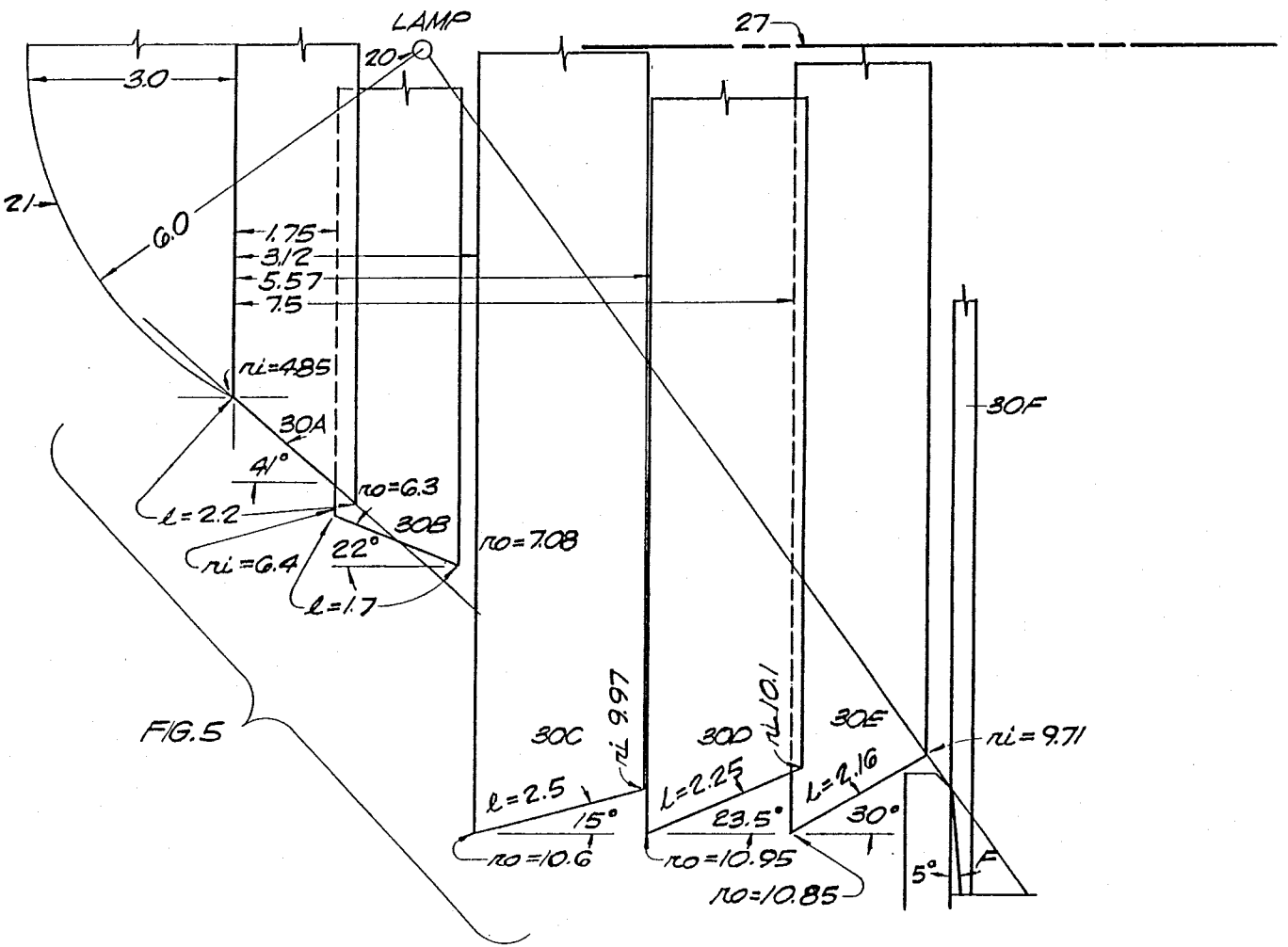
FIG. 5 is a side elevational view of a preferred arrangement of the conical reflector segments.

Having described in general the configuration and different manners of arranging a lamp reflector comprising a series of segments defining a spaced array, now is an appropriate time to consider a specific and preferred embodiment of such an array. FIG. 5 and Table I define such an array in some detail. In this preferred embodiment, segments 30A and 30B are operationally fixed to reflector 21 and therefore move in concert with the reflector 21 and lamp 20 when the assembly is changed between its spot and flood configurations. Segments 30A–30E, on the other hand, are fixed within enclosure 10 and preferably are not moved along axis 27 when the lamp is changed from its spot to flood configuration and visa versa.

The sizes and shapes of reflector segments 30A–30E are defined in Table I. Thus, considering briefly reflector segment 30A, it preferably has an inside radius of 4.85 inches and an outside radius of 6.3 inches. Both radii are taken relative to the optical axis 27 of the lamp. The segment of the cone defined by segment 30A is disposed at a 41° angle to the optical axis and has a length of 2.2 inches. As can be seen from FIG. 5, segments 30A and 30B not only move with reflector 21 but also reflect light towards the Fresnel lens 11. Segments 30C–30E, on the other hand, reflect light back toward reflector 21 and segments 30A and 30B, which in turn reflect the light reflected off of segments 30C–30E towards Fresnel lens 11. Spherical reflector, in this embodiment, has a 6 inch radius and the focal length of the Fresnel lens 11 is preferably 10.63 inches. The position of the spherical reflector in FIG. 5 is for the assembly in its spot configuration. When in flood, the lamp 20 and associated reflectors 21, 30A and 30B are moved toward the Fresnel lens 11 so that in this embodiment, the lamp 20 is about 4 inches away from same and the front edges of segments 30E and 30B are essentially the same distance from lens 11.

Figure 4:
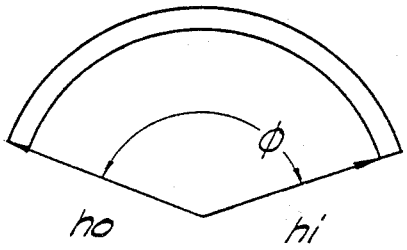
FIG. 4 is a plan view of the sectioned reflector of FIG. 3B, after cuts have been performed therein but before it has been folded to take a polygonal shaping cross section as shown in FIG. 3B.

Turning to Table I, it shows the inside radius ($r_i$), outside radius ($r_o$), length (l) and angle ($\theta$) which the segment takes with respect to the optical axis 27 of the fixture as well as the distance (d) from the periphery of the spherical reflector 21 to the rear edge of the segment reflector 30 when in its "spot" position. Additional data is provided which will now be described. Those skilled in the art will appreciate that it would be desirable to manufacture the segments 30A–30E out of a sheet of a material, such as polished aluminum, type C4 manufactured by Kinglux, which is fairly easily mechanically formed and which has good shock and high temperature characteristics. If appropriate forms are cut from a sheet of material, they can be bent around upon themselves to form the sections of a cone or cylinder. The data for forming reflector segments 30A–30E from a flat sheet of material is depicted in Table I for the dimensions $h_i$, $h_o$ and $\phi$, which dimensions are defined with respect to FIG. 4 which shows a pattern for cutting the segments from a sheet of flat material. The segments would thereafter be bent to join their free ends to form the conical sections required. If necessary, the sections may be split as needed to define clearance 32 discussed with reference to FIG. 2.

TABLE I

| REFLECTOR | $r_i$ | $r_o$ | l | sin $\theta$ | $\theta$ | $h_i$ | $h_o$ | $\phi$ | d |
|---|---|---|---|---|---|---|---|---|---|
| 30A | 4.85 | 6.3 | 2.2 | .656 | 41° | 7.393 | 9.604 | 236° | 0 |
| 30B | 6.4 | 7.08 | 1.7 | .375 | 22° | 17.067 | 18.88 | 135° | 1.75 |
| 30C | 9.97 | 10.6 | 2.5 | .259 | 15° | 38.494 | 40.927 | 93° | 3.12 |
| 30D | 10.1 | 10.95 | 2.25 | .399 | 23.5° | 25.31 | 27.444 | 144° | 5.57 |

TABLE I-continued

| REFLECTOR | $r_i$ | $r_o$ | l | sin θ | θ | $h_i$ | $h_o$ | φ | d |
|---|---|---|---|---|---|---|---|---|---|
| 30E | 9.77 | 10.85 | 2.16 | .5 | 30° | 19.54 | 21.17 | 180° | 7.5 |

EQUATIONS RELATING THESE VARIABLES:

$$\text{SIN}\ \theta = \frac{r_o - r_i}{l}$$

$$h_i = \frac{r_i}{\sin\theta}$$

$$h_o = \frac{r_o}{\sin\theta}$$

$$\phi = 360\frac{r_o}{h_o}$$

$$\sin\theta = \frac{r_i}{h_i}$$

The arrangement of reflector segments 30A–30E shown in FIG. 5 is an optimum arrangement for when movable reflector 21 is in its rearwardmost position so that the fixture produces a "spot" of light. As the movable mirror 21 is moved towards its forwardmost or "flood" position, the positions of reflector segments 30C–30E become less and less ideal. Certainly if the positions of reflector segments 30C–30E could be rotated as movable reflector 21 moves forwardly within the fixture, this would be preferable compared to having them fixed. It would likely require, however, the use of a camming mechanism interconnected with the carriage assembly 23 (FIG. 2) to rotate the positions of reflectors 30C–30E as movable reflector 21 moves forward within the fixture.

By using the additional reflector segments, the amount of light cast by the lamp through Fresnel lens 11 can be increased by up to 33% and perhaps more. This is certainly a notable improvement. However, given the fact that one third or more of the light generated by lamp 20 is lost within the enclosure and the fact that the segments can increase the amount of transmitted light by around two-thirds, those skilled in the art will appreciate that there is still room for additional improvement in effectively transmitting the light from the lamp 20 through the Fresnel lens 11. In a normal fixture, the spherical reflector 21, lamp 20 and Fresnel lens 11 are all centered axially with respect to the optical axis 27 of the device. Thus, the return image from the spherical reflector 21 falls approximately in the same position as the arc itself within lamp 20. Unavoidably, the excited gas in the arc which emits the light is also capable of absorbing light of the same wavelength. Therefore, the returned image reflected by spherical reflector 21 is partially absorbed in the gas within lamp 20.

Because of the spherical geometry of the reflector 21, the reflecting light re-enters the lamp fairly efficiently, that is, at basically a normal angle of incidence. If the spherical reflector is defined by two spherical sections, the reflecting light can be directed so as to miss filament 20' of lamp 20 entirely, forming reflected images immediately above and below the arc of the lamp. FIG. 6A is a front elevational view of a conventional spherical reflector 21. A pair of conventional spherical reflectors 21 are preferably parted at chord or part line 28 and the major portions thereof joined along their part lines 28 as depicted in elevational view 6B forming a double section reflector 221. The chord or part line 28 is shown in FIGS. 6A–6F at an exaggerated distance from the center of the reflector 21. Actually, the distance between the part line 28 and the center of the reflector 21 should only be on the order of perhaps 2% of the diameter of reflector 21.

The individual units 221A and 221B of reflector 221 are each defined by the major portion of a parted conventional reflector 21 as described with reference to FIG. 6A. Of course, instead of manufacturing reflector 221 from two conventional reflectors 21, others may prefer to manufacture it as an integral unit.

In FIG. 6C, the double sectioned reflector 221 of FIG. 6B is shown in a side sectional view. The two sections 221A and 221B are preferably rotated slightly outwardly from each other so as to locate their focus points 220A and 220B immediately above and below the arc or filament 20' of lamp 20.

As will be subsequently described, focus points 220A and 220B which provide images of the arc or filament 20' of lamp 20 preferably occur immediately adjacent to the arc or filament 20' of lamp 20 as will be described with reference to FIGS. 7A and 7B. The focus points 220A and 220B are shown more widely separated in FIG. 6C for the ease of illustration.

Turning to FIG. 7A, there is shown a front elevational view of arc or filament 20' of lamp 20 as well as focus points 220A and 220B which are found in this embodiment immediately above and immediately below the arc or filament 20'. The effect of this arrangement is to "round out" the light produced by arc or filament 20' to make it more compatible with a Fresnel lens, for example. Also, there is the advantage of not having the arc or filament absorb the light reflected by the spherical reflectors.

As can be seen by comparing FIGS. 7A and 6C, if the arc or filament 20' of lamp 20 is elongated as shown in FIG. 7A, then the direction of part line 28 should be arranged basically parallel to the elongation of arc or filament 20'.

Additional advantages can be obtained by further splitting the reflector vertically and permitting the left hand or right hand portions to tilt inward thereby concentrating the "bright spots" at either end of the arc by centering the ends of the reflected image. In FIG. 6D another conventional spherical reflector 21 is shown with a first chord or part line 28 which is used for the same purpose as part line 28 described with reference to FIGS. 6A–6C. Those skilled in the art will appreciate that part line 28 defines a chord of the circle defined by spherical reflector 21. A second chord or part line 29 is also depicted in FIG. 6D which chord is arranged at right angles to chord or part line 28 and which passes through the center of the circle defined by the spherical reflector. The part lines define two larger segments and two smaller segments and the smaller segments can be discarded, assuming that they are created or manufactured in the first place. Two additional larger segments are similarly created and all four segments then arranged with their concave surfaces forward as depicted in the elevation view of FIG. 6E to form a quad section reflector 221. Again, the upper segments, segments 221C and 221D are preferably rotated slightly outwardly compared to segments 221E and 221F as previously discussed with reference to FIG. 6C to move the points of focus immediately above and below lamp 20. As depicted in FIG. 6F, and as suggested by the arrows shown in that figure, segments 221C and 221E are rotated slightly towards segments 221D and 221F placing the hot spot, as seen by a quadrant, closer to the systems center. This is effective if the arc can be logically represented as two sources, radiating primarily in opposite directions. For the typical 12 KV lamp used in the industry, this is believed to be a valid model of its light output.

FIG. 7B is a front elevational view of arc or filament 20 and the four images 220C–220F produced by segments 221C through 221F if, indeed, the arc has two bright spots or hot spots at the ends of the arc, which is typical for the 12 KV lamp mentioned above, then the bright spots at the ends of the images 220D through 220E are shifted toward the center compared to a conventional spherical reflector or even compared to the improved reflector described with reference to FIGS. 6A–6C. In FIG. 7B, image 220C is shown slightly farther from arc or filament 20' than image 220D for the ease of illustration. Usually, image 220C would partially overlie image 220D and similarly image 220E would partially overlie image 220F assuming, of course, that each of the segments 221C through 221F are of the same size and are equally tilted with respect to the optical axis 27 of the lamp. Indeed, those skilled in the art, will likely now appreciate that the amount of tilting or rotation of the segments with respect to each other for the embodiments of FIGS. 6A through 6F are quite small and will usually be less than 5 degrees of tilt or rotation with respect to each other.

The images 220 and 220B shown in FIG. 7 may be so close to arc or filament 20' that they will likely pass through the glass envelope in which arc or filament 20' is disposed. Similarly, the images 220C through 220F produced by segments 221C through 221F and shown in FIG. 7B will likely also pass through the glass envelope of lamp 20 since they are disposed immediately adjacent to arc or filament 20'.

Having described the invention in connection with specific embodiments thereof, modification may now suggest itself to those skilled in the art. Accordingly, the invention is not to be limited to the foregoing description, except as required by the appended claims.

What is claimed is:

1. A reflecting mirror for reflecting a beam of light emitted from a longitudinal light source, said mirror comprising at least two sections, each of which is arranged to produce an image of the light source adjacent to but not coincident with the light source, each of said sections being joined at a part line which is arranged parallel to the longitudinal axis of said light source.

2. The reflecting mirror of claim 1, wherein each of said sections is defined by a portion of a sphere.

3. The reflecting mirror of claim 1, wherein said mirror comprises four sections, the four sections being joined at said part line and at a second part line, said second part line being arranged at a right angle to the longitudinal axis of said light source.

4. The reflecting mirror of claim 1, wherein said mirror comprises four sections, the four sections being joined at part lines, one of which is disposed parallel to the longitudinal axis of the light source and another of which is disposed at right angles to the longitudinal axis of the light source.

5. The reflecting mirror of claim 4, wherein each of said sections is defined by a portion of a sphere.

6. The reflecting mirror of claim 4, wherein two of the images of the light source are at least partially superimposed upon each other.

7. A reflecting mirror for reflecting a beam of light emitted from a longitudinal light source, said mirror comprising at least two sections, each of which is arranged to produce an image of the light source, each of said sections being joined at a part line which is arranged at a right angle to the longitudinal axis of said light source.

8. The reflecting mirror of claim 7, wherein said mirror comprises four sections, the four sections joined at said part line and at a second part line, said second part line being arranged parallel to the longitudinal axis of said light source.

9. The reflecting mirror of claim 8, wherein each of said sections is defined by a portion of a sphere.

10. The reflecting mirror of claim 8, wherein each of said four sections produces an image of the light source which is adjacent but not coincident with the light source and wherein at least two of the images of the light source are at least partially superimposed on each other.

11. The reflecting mirror of claim 7, wherein each of said sections is defined by a portion of a sphere.

* * * * *